United States Patent [19]

Savio et al.

[11] 4,090,677

[45] May 23, 1978

[54] APPARATUS FOR STORING AND FEEDING YARN TO YARN USING MACHINES

[75] Inventors: Ermanno Savio; Sergio Calamani; Eugenio Turri, all of Milan, Italy

[73] Assignee: Savio e C. S.p.A., Milan, Italy

[21] Appl. No.: 779,599

[22] Filed: Mar. 21, 1977

[30] Foreign Application Priority Data

Dec. 17, 1976 Italy ..... 30543 A/76

[51] Int. Cl.[2] ..... B65H 51/20

[52] U.S. Cl. ..... 242/47.01; 242/47.12

[58] Field of Search ..... 242/47.01, 47.04, 47.05, 242/47.12, 47.13, 78, 82, 83; 66/132 R; 139/122 R

[56] References Cited

U.S. PATENT DOCUMENTS

| | | | |
|---|---|---|---|
| 3,720,384 | 3/1973 | Rosen | 242/47.01 |
| 3,737,112 | 6/1973 | Tellerman et al. | 242/47.01 |
| 3,776,480 | 12/1973 | Lawson | 242/47.01 |
| 3,791,598 | 2/1974 | Vischiani et al. | 242/47.12 |
| 3,796,384 | 3/1974 | Rosen | 242/47.12 |
| 3,944,156 | 3/1976 | Jacobsson et al. | 242/47.12 |

*Primary Examiner*—Stanley H. Gilreath
*Attorney, Agent, or Firm*—Haseltine, Lake & Waters

[57] ABSTRACT

An apparatus for storing and feeding yarn to yarn using machines, comprising a base plate carrying a freely rotatable shaft which supports a drum through ball bearings and a dispensing arm which distributes turns of yarn upon the drum. Two coaxial rolling bearings surround the shaft one being supported by the base plate and the other by the drum and the bearings are connected to one another by a rigid body having a passage through which the arm passes, thus preventing rotation of the drum with respect to the base plate.

2 Claims, 2 Drawing Figures

APPARATUS FOR STORING AND FEEDING YARN TO YARN USING MACHINES

FIELD OF THE INVENTION

This invention relates to an apparatus for storing and feeding yarn to yarn using machines, such as looms, knitting machines, stocking machines and the like.

PRIOR ART

It is known that many using machines, such as those above mentioned, are not directly fed with the yarn from the bobbin, cop, spool or the like, but the yarn from the bobbin reaches the using machine after being previously wound on an apparatus, where the yarn is formed in a magazine or supply and is then supplied to the using machine.

Known apparatuses are substantially in the form of a drum, on one end of which the turns of yarn are wound, the yarn being drawn from the other end of the drum. Rocking rigid mechanical members are then provided, such members acting on the turns of yarn wound on the drum, causing the translation thereof from that end of the drum, to which they are fed, to the other end of the drum, where the yarn is drawn.

In some types of apparatus, such as those disclosed in U.S. Pat. Nos. 3,672,590 and 3,702,176 and in French Pat. No. 1,540,968, the drum rotates about its own axis, drawing the yarn through a feeding hook or eyelet.

In other types of apparatus, such as those disclosed in U.S. Pat. Nos. 3,093,339, 3,776,480 and 3,834,653, the drum on which the turns of yarn are wound is stationary, and the yarn is fed to the base of the drum by a rotating arm.

In order to translate the yarn turns along the outside surface of the drum, mechanical members of different type are known, such as those described in U.S. Pat. Nos. 2,625,340, 3,419,225 and 3,093,339, comprising a rocking plate relative to the drum and positioned at that end of the drum where the yarn turns are laid down, said plate having an arc of its surface which is always contacting a length of that turn which is the closest thereto and is the last laid down by the rotating arm. The rocking movement of the plate causes the displacement of the turn in contact therewith, and this turn urges and forwardly slides the turns adjacent thereto.

In those apparatuses having a stationary drum, on which the turns are laid down by a rotating arm, different means are provided for preventing the drum from rotating, which drum is mounted on a rotating shaft also carrying the yarn distributing arm. According to particular embodiments, such as those disclosed in U.S. Pat. Nos. 3,093,339, 3,720,384, 3,737,112, 3,796,384 and 3,776,480 and in French Pat. No. 2,103,687, a set of gears is provided mounted either on the rotating shaft or on the distributing arm, and distinct crown gears coaxial with one another and integral with the stationary base plate and drum, respectively. This mechanical gearing system suffers from substantial disadvantages, such as the high cost of manufacture and assembly, substantial noise and the requirement of constant maintenance and lubrication.

In other types of apparatus, such as that described in U.S. Pat. No. 3,834,635, the drum is prevented from rotating by magnetic effect, that is by incorporating permanent magnets within the drum, whereas further permanent magnets are incorporated within a stationary structure externally of the drum, the last mentioned magnets being opposite those integral with the drum. Also in this case, such disadvantages would arise as those particularly residing in that the drum does not remain perfectly stationary, and this particularly when the yarn is drawn intermittently therefrom and at a high speed, and also in the high cost of manufacturing such apparatuses.

SUMMARY OF THE INVENTION

It is the primary object of the present invention to provide a stationary drum type of yarn feeding apparatus having a yarn distributing arm rotating about an axis coincident with the drum axis, such apparatus being provided with members of a simple structure, easy assembly, reliable operation, low noise, and substantially not requiring any maintenance or servicing, in order to hold the drum at a quite stationary condition during the rotation of the yarn distributing or dispensing arm and drawing of the yarn from the drum.

These and still other objects are accomplished by an apparatus comprising a base plate securable to a stationary structure, a shaft freely rotatably mounted on at least one rolling bearing carried by said base plate with the ends of said shaft extending from said base plate on one side, and on the other side of which the two ends of the shaft project, a member on one end of said shaft for coupling said shaft to a motor and being rotatably driven thereby, a hollow drum having a cylindrical outside surface carried by the other end of said shaft through at least one rolling bearing having its axis substantially coincident with that of the shaft, a yarn dispensing arm positioned between said base plate and drum and integral with said shaft, and having a channel passing therethrough, said channel extending to and opening in the shaft end externally of the drum and at the adjoining cylindrical end of the drum, respectively, to distribute turns of yarn incoming through said channel, a rocking body for transferring the yarn turns onto the drum, said rocking body being rotatably mounted on said shaft, and means for preventing the drum from rotating on said shaft, the apparatus being characterized in that said means for preventing the drum from rotating comprising two rolling bearings having a common axis parallel to but offset relative to the axis of said shaft extending through said bearings, of which one has a cage fixed to said base plate, and the other has a cage fixed to the opposing surface of said drum, a rigid connecting body for the movable cages of said bearings being mounted on said two bearings, said connecting body having a passage through which said yarn dispensing arm passes.

BRIEF DESCRIPTION OF THE DRAWINGS

In order that the structure and features of the apparatus according to the invention be more clearly understood, an embodiment thereof will now be described, as given by mere way of unrestrictive example, reference being had to the accompanying drawings, in which.

DETAILED DESCRIPTION

Figure 1:
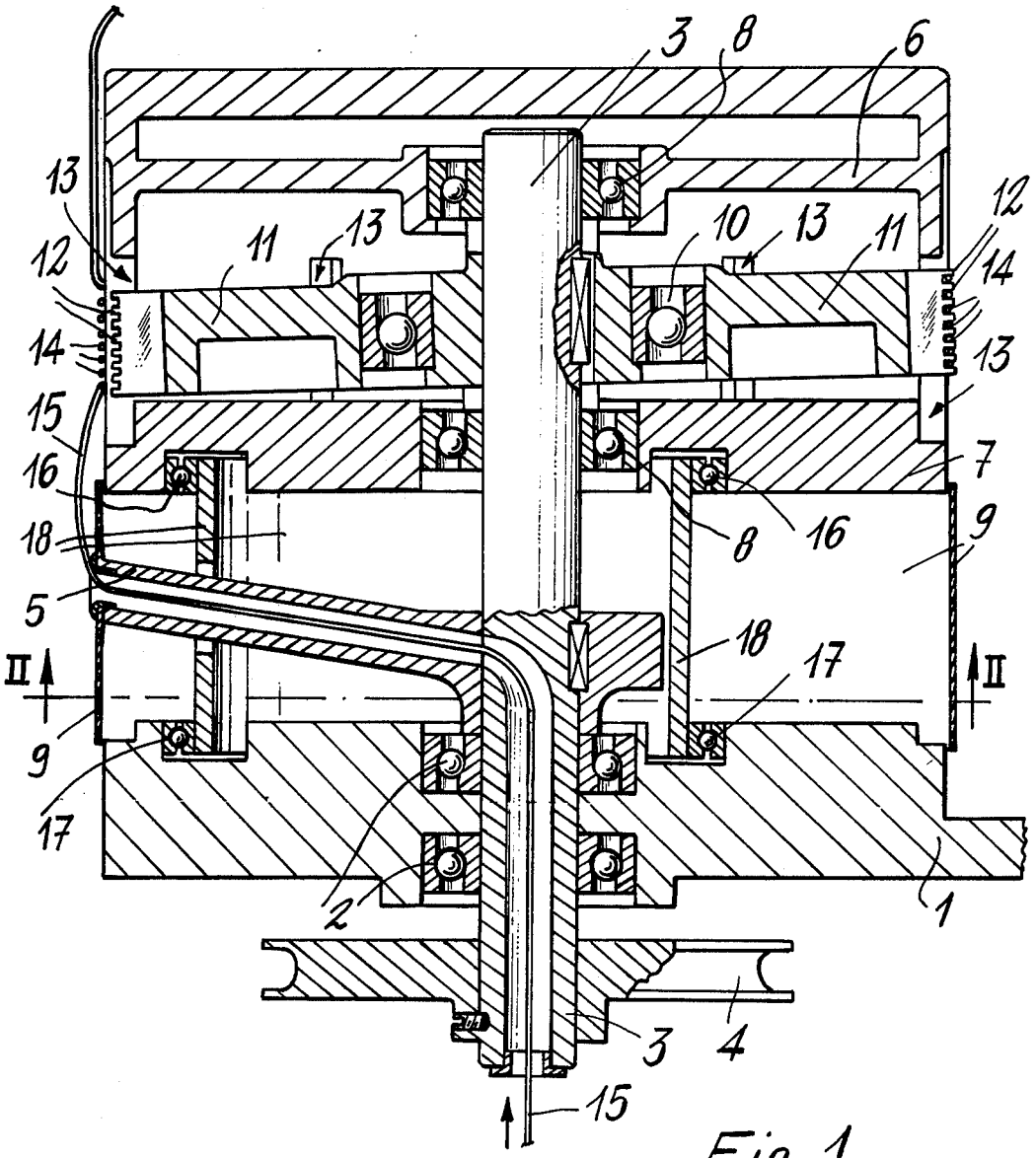
FIG. 1 is an axial sectional view of the apparatus.
Figure 2:
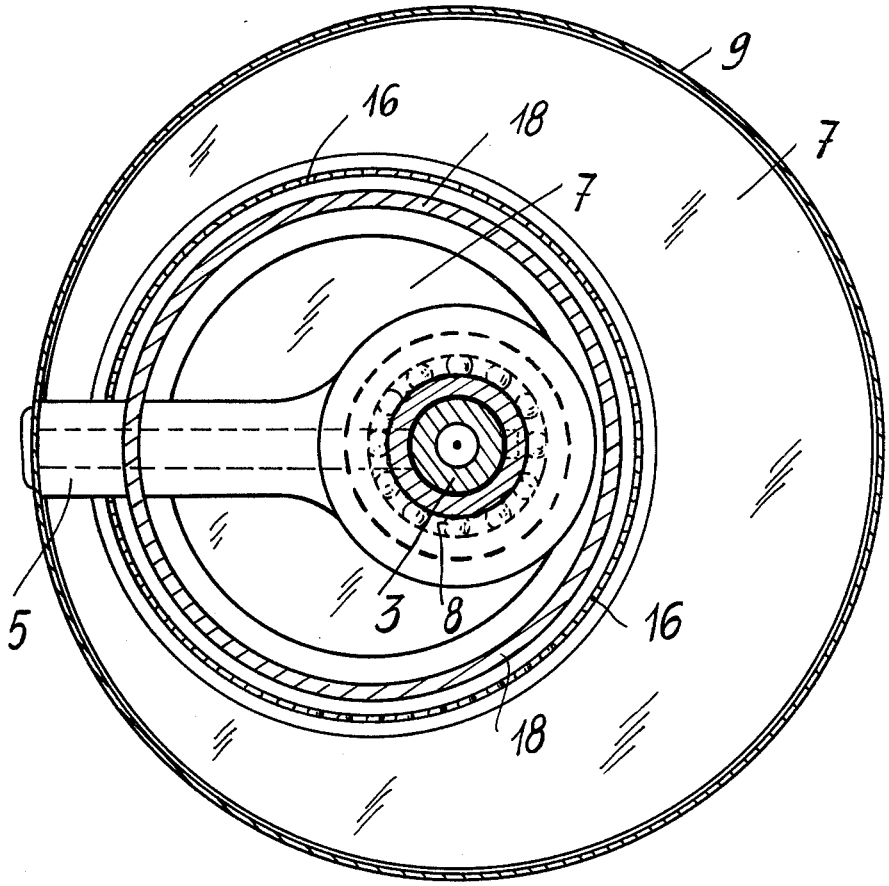
FIG. 2 is a sectional view of the apparatus taken along line II—II in FIG. 1.

As particularly shown in FIG. 1, the apparatus according to the invention comprises a base plate 1 securable to a stationary frame. By means of bearings 2 the base plate supports a rotating shaft 3 having a pulley 4 mounted on its lower end and connectable, for instance, by a belt (not shown in the drawings), to an electric motor rotatably driving the shaft. A yarn dispensing arm 5 extends from shaft 3 and has a duct or channel passing therethrough also extending in the underside of shaft 3, as clearly shown in FIG. 1.

An internally hollow drum is provided above said rotary arm 5 and is laterally defined by a cylindrical surface, an inner wall 6 and a plate 7 integral therewith, which plate 7 is secured to the lower end of the drum. The plate 7 defines with base plate 1 an empty space, within which said yarn dispensing arm 5 is freely movable. The drum is carried by shaft 3 by means of bearings 8 mounted on inner wall 6 and plate 7.

The space defined between plates 1 and 7 is externally closed by a ring 9 integral with the free end of arm 5, as shown in FIG. 1.

A bearing 10 is mounted on shaft 3 and has its axis inclined with respect to the axis of said shaft 3, bearing 10 carrying a rigid disc 11 which is milled on its periphery so as to form a plurality of regions with grooves 12 superimposed on one another, such regions being distributed throughout the periphery of disc 11 and being positioned opposite openings or slots 13 in the cylindrical wall of the drum. During the rotation of shaft 3 about its own axis, assuming that said disc 11 cannot rotate as retained by the drum, disc 11 will oscillate and the regions with grooves 12 will move in a radial as well as axial direction, these grooves engaging the turns 14 of yarn 15 laid down on the drum by arm 5 and upwardly moving the turns. This turn transferring device is well known, being described for example in Swiss Pat. No. 582,107.

In order to prevent the drum from rotating on shaft 3, a device is provided comprising two rolling bearings 16 and 17, respectively, having one cage fixed to the drum plate 7 and plate 1, respectively. A cylindrical tubular body 18 is integral with the movable cages of the two bearings 16 and 17 and has its axis coincident with the axis of the two bearings. The axis of these bearings is parallel to, but offset relative to the axis of shaft 3. A hole is provided in cylindrical tubular body 18 and slidably receives the yarn dispensing arm 5.

Since the cylindrical tubular body 18 is free to rotate only about its own axis (coincident with the axes of bearings 16 and 17) and not about the axis of shaft 3 (because one cage of bearing 17 is fixed to plate 1), as a result, the drum cannot rotate on shaft 3 relative to plate 1.

During the operation of the apparatus, the pulley rotably drives arm 5 about the axis of shaft 3. Arm 5 causes the cylindrical tubular body 18 to rotate about the axes of bearings 16 and 17. During this rotary motion, arm 5 more or less moves out of the hole in said cylindrical tubular body 18, depending on its angular position with respect to the stationary plate 1. In any case, the drum carried by the shaft remains perfectly stationary, and the turns of yarn incoming through the channel in shaft 3 and arm 5 are laid down at its lower end.

The apparatus can be provided with means for controlling the number of turns wound on the drum and stopping or starting the motor driving the pulley 4, such controlling means not having been described for the sake of simplicity as per se well known in the art, which means can be mechanical members, such as those described in U.S. Pat. No. 3,776,480 and in French Pat. No. 1,275,633, or comprise photocells, such as those described in U.S. Pat. No. 3,672,590 and in French Pat. No. 1,540,968.

It should also be understood that the yarn 15, arriving from a bobbin or similar yarn supply and passing through the duct or channel in the arm 5 to form the turns 14 on the drum, prior to being drawn from the drum, or immediately after unwinding from the latter, can pass to a device for controlling the yarn tension, such a device not being here described for the sake of simplicity, since it can be of any type known in the art, such as those disclosed in U.S. Pat. Nos. 3,093,339, 3,702,176 and 3,834,635. Finally, the device described for preventing the drum from rotating relative to the fixed plate 1, is of a very simple realization, of a reliable and noiseless operation, low cost and substantially does not require any maintenance or servicing.

What we claim is:

1. An apparatus for storing and feeding yarn to yarn using machines, comprising a base plate securable to a stationary structure, a shaft freely rotatably mounted on at least one rolling bearing carried by said base plate with the ends of said shaft extending from said base plate, a member on one end of said shaft for coupling said shaft to a motor and being rotatably driven thereby, a hollow drum having a cylindrical outside surface carried by the other end of said shaft through at least one rolling bearing having its axis substantially coincident with that of the shaft, a yarn dispensing arm positioned between said base plate and drum and integral with said shaft, and having a channel passing therethrough, said channel extending to and opening in the shaft end externally of the drum and at the adjoining cylindrical end of the drum, respectively, to distribute thereon turns of yarn incoming through said channel, a rocking body for transferring the yarn turns onto the drum, said rocking body being rotatably mounted on said shaft, and means for preventing the drum from rotating on said shaft, said means for preventing the drum from rotating comprising two rolling bearings having a common axis parallel to but offset relative to the axis of said shaft extending through said bearings, of which one has a cage fixed to said base plate, and the other has a cage fixed to the opposing surface of said drum, a rigid connecting body for the movable cages of said bearings being mounted on said two bearings, said connecting body having a passage through which said yarn dispensing arm passes.

2. An apparatus according to claim 1, wherein said rigid connecting body for the movable cages of the bearings is substantially in the form of a cylindrical cage.

* * * * *